United States Patent [19]

Henriksson

[11] Patent Number: 4,765,062

[45] Date of Patent: Aug. 23, 1988

[54] ARRANGEMENT IN A CHAIN SAW

[75] Inventor: Sören N. Henriksson, Kållered, Sweden

[73] Assignee: Aktiebolaget Electrolux, Sweden

[21] Appl. No.: 93,721

[22] Filed: Sep. 2, 1987

[30] Foreign Application Priority Data

Sep. 19, 1986 [SE] Sweden ..... 8603954

[51] Int. Cl.[4] ..... B27B 17/02

[52] U.S. Cl. ..... 30/384; 30/383

[58] Field of Search ..... 30/383, 1, 387

[56] References Cited

U.S. PATENT DOCUMENTS 285,651 9/1883 Newlove ..... 30/387

3,263,715 8/1966 Dobbertin ..... 30/384

4,693,007 9/1987 Apfel et al. ..... 30/383 X

*Primary Examiner*—Frank T. Yost

*Attorney, Agent, or Firm*—Alfred E. Miller

[57] ABSTRACT

An arrangement for decreasing the strain on a rivet joint of the top wheel in a motor saw. Lateral forces in consequence of unvoluntary jamming or twisting of the saw chain by its surrounding of the top of the sword cannot be totally avoided, which often gets the rivet joint (17) of the top wheel loose. In order to avoid such a thing it is suggested to provide a releasing slot (19) which separates the chain guiding portion of the outer sheets (10,11) of the saw sword from the riveted portion forming the inner roll bearing surface of the top wheel, which slot is extending through at least 180° thereof.

4 Claims, 1 Drawing Sheet

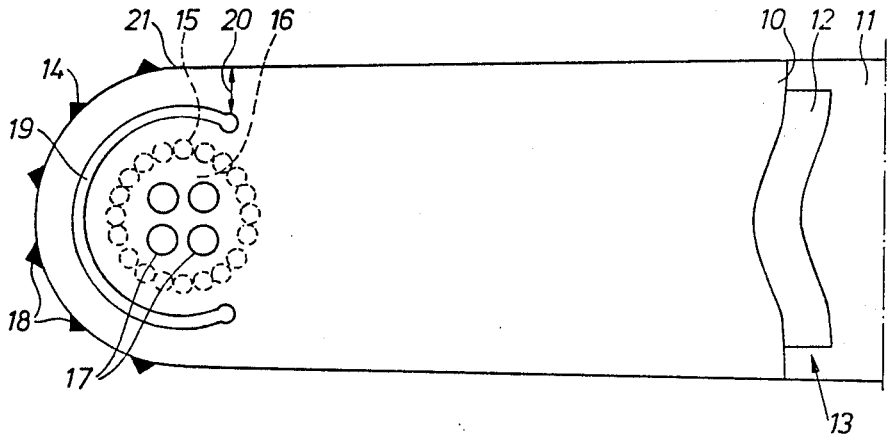
21
15
20
16
10
12
11
14
19
18
17
13

ARRANGEMENT IN A CHAIN SAW

The present invention relates to an arrangement in a chain saw which eliminates damages to the bar when the chain jams in a work piece or the bar is subjected to twisting forces.

A bar comprises usually three plates which ar glued, welded or riveted to each other. The outer plates form the edges of the chain groove in which the chain runs. The center of the top wheel is also fastened to the outer plates by means of rivets. Lateral forces in consequence of unvoluntary jamming or twisting of the saw chain by its surrounding of the top wheel cannot be totally avoided and will bring about a break in the rivet joint between the center of the top wheel and the outer plates. The top wheel will then become loose and makes no longer a rigid turning point to the saw chain. In order to avoid unnecessary risks to the operator caused by a faulty chain saw the improvement will often be that the bar is replaced by a new one, when the top wheel gets loose.

In accordance with the present invention there is an arrangement in the chain saw bar which prevents damages as a consequence of twisting forces, as here described, by providing a releasing slot which separates a chain guiding portion of the outer plates of the saw sword from the riveted portion forming an inner roll bearing surface of the top wheel between the outer plates. The guiding portion thereby gets a certain mobility against the riveted portion and the forces emanating from jamming of the chain will thus not be transferred to the riveted joint which then remains intact.

An embodiment of the invention will be described in the following with reference to the accompanying drawing which shows a part of a chain saw bar in a vertical projection.

The chain saw bar, as seen in the FIGURE, is composed of three stamped plates, two outer plates 10,11 and one inner plate 12. The two outer plates have the same contour and form a chain groove 13 which has a bottom constituted of the periphery of the inner plate, which thus is somewhat smaller than the outer plates. The plates are spot-welded to each other and constitute a rigid and resistive structure.

At the top end of the bar the inner plate makes a room for a top wheel 14 which is journalled by means of rollers 15 on a circular center disc 16. The wheel and the disc have the same thickness as the inner plate and fill the space between the outer plates. The center disc is fixed to the outer plates by a rivet joint with, for instance, four rivets 17 which have heads at least partly sunk into the rivet holes in the outer plates. The top wheel is a toothed wheel having teeth 18 protruding into the chain groove between the outer plates. These teeth enter into the links of the saw chain when this one is put into the groove and keep then the link a little bit out from the edges of the outer plates at the arcuate end of the bar so that the friction of the chain in the bar is reduced. So far as now described, the design of the saw sword is conventional and it constitutes then a basis for the novelty of the invention.

The pressure and strain on the bar mentioned in the introduction arises when the operator, after jamming of the bar in a work piece, turns and swings the saw in order to free it. If the sword is wholly rigid all the way to the end past the top wheel, the rivet joint is deformed owing to the bending and shearing stress between the plates. In the shown embodiment this stress is prevented from working upon the rivet joint by means slot 19 provided in the outer plates and extending concentrically at least through 180° around the center of the top wheel. The slots have suitably such an extension that the distance 20 from the slot to the perphery 21 of the outer plates is increasing in the direction towards the saw body. The elasticity in the arcuate end of the sword is thereby gradually increasing in the direction out from the saw body. The slots can be stamped in the outer plates so they only consist of a slit having its edges abutting each other. Thus, the accumulation of chips, and the like, in the slots is avoided. Other types of slots, such as made by milling or cutting are also possible with the scope of the present invention.

I claim:

1. A chain saw having a handle and provided with a chain saw bar comprising three layers of flat plates secured together with the inner plate being smaller than said outer plates thereby forming a peripheral track, a top wheel journalled on a roller bearing surface in the bar at a location remote from said handle, a slot in each of the outer plates having an extension substantially concentric to the center of said top wheel.

2. The arrangement as claimed in claim 1 wherein the slot in each outer plate describes an arc positioned between the peripheral edge of said outer plate and the roller bearing surface of said top wheel.

3. The arrangement as claimed in claim 2 wherein the ends of said slot are located a greater distance from the adjacent peripheral edge of said outer plate than another point in said slot to an adjacent peripheral edge of said outer plate between said ends.

4. The arrangement as claimed in claim 2 wherein sid arc is extended more than 180° around the center of said top wheel.

* * * * *